United States Patent [19]

Kopf et al.

[11] Patent Number: 5,052,280

[45] Date of Patent: Oct. 1, 1991

[54] COOLABLE TRUNK PISTON FOR INTERNAL COMBUSTION ENGINES

[75] Inventors: Eberhard Kopf; Joachim Wille, both of Stuttgart, Fed. Rep. of Germany

[73] Assignee: Mahle GmbH, Stuttgart, Fed. Rep. of Germany

[21] Appl. No.: 609,094

[22] PCT Filed: Oct. 24, 1987

[86] PCT No.: PCT/EP87/00633

§ 371 Date: Jun. 8, 1989

§ 102(e) Date: Jun. 8, 1989

[87] PCT Pub. No.: WO88/04725

PCT Pub. Date: Jun. 30, 1988

Related U.S. Application Data

[63] Continuation of Ser. No. 375,022, Jun. 8, 1989, abandoned.

[30] Foreign Application Priority Data

Dec. 17, 1986 [DE] Fed. Rep. of Germany ..... 3643039

[51] Int. Cl.[5] ..... F02F 3/22; F02F 3/00

[52] U.S. Cl. ..... 92/186; 92/159; 92/190; 123/41.35

[58] Field of Search ..... 92/158, 159, 186, 187, 92/190, 238, 239; 123/41.35

[56] References Cited

U.S. PATENT DOCUMENTS

| | | | |
|---|---|---|---|
| 1,825,163 | 9/1931 | Schweter | 92/186 X |
| 2,698,210 | 12/1954 | Baller | 92/141 |
| 3,336,844 | 8/1967 | Cornet | 92/186 X |
| 3,805,677 | 4/1974 | Clary et al. | 92/186 |
| 4,377,967 | 3/1983 | Pelizzoni | 92/186 |
| 4,505,233 | 3/1985 | Kanda et al. | 92/186 X |
| 4,506,632 | 3/1985 | Kanda et al. | 92/186 X |

FOREIGN PATENT DOCUMENTS

| | | | |
|---|---|---|---|
| 2323022 | 1/1977 | France | 123/41.35 |
| 422426 | 4/1967 | Switzerland . | |

*Primary Examiner*—Edward K. Look
*Assistant Examiner*—George Kapsalas
*Attorney, Agent, or Firm*—James Creighton Wray

[57] ABSTRACT

In a two-piece piston with a head piece and a trunk hinged only over the piston pin, the annular space radially located inside the piston ring groove and open in the direction of the trunk is covered with a sheet metal wall part forming a cooling duct. The sheet metal wall part is held by a collar that extends from the outer annular wall of the head piece and is cramped around the sheet metal wall part. For optimally covering the annular space, the sheet metal wall part is radially divided into two parts.

24 Claims, 2 Drawing Sheets

COOLABLE TRUNK PISTON FOR INTERNAL COMBUSTION ENGINES

This application is a continuation of application Ser. No. 375,022 filed June 8, 1989, now abandoned.

BACKGROUND OF THE INVENTION

The invention relates to a coolable trunk piston for internal combustion engines.

Such pistons are known from U.S. Pat. No. 4,377,967. The wall part (shaped sheet metal) which is used in those pistons to cover the cavity which forms the cooling oil space is flanged onto the outer periphery of the annular wall which carries the piston rings. This type of fixing is not secure, because flanging of the relatively thin-gauge wall part can become detached in the long term under the conditions in which engines operate.

The use of a one-piece thick gauge and thus, by reason of its greater rigidity, a wall part which guarantees a more reliable attachment is in turn undesirable for different reasons. The outer annular part of the piston head which accommodates the piston rings ought during operation of the engine to be able to change its shape at its bottom end without being hindered by the incorporated wall part. Such deformations take place due to the combustion processes which take place in the manner of explosions and, if they are inhibited, they can cause cracks in the piston head material. In this respect, one-piece sheet metal covering such as are known from FR-A 23 23 022 or coverings which consist of individual parts rigidly connected to each other, such as are described in the case of pistons in U.S. Pat. No. 2,698,210 are equally unsuitable for the necessary covering of the annular cooling oil cavity.

It is on this premise that the invention is based on the problem in the case of the piston known from U.S. Pat. No. 4,377,967, of providing a covering which ensures on the one hand movements of the bottom end of the outer annular wall of the piston head while on the other is sufficiently securely attached to the piston head.

SUMMARY OF THE INVENTION

This problem is resolved by an embodiment of construction and attachment of the wall part which covers the cooling oil cavity.

The collar projecting from the annular wall and which is flanged over the wall part can be made substantially thicker than the wall part itself and it can therefore provide a more rugged flanged connection. The existence of joints between the multi-part covering wall guarantees the necessary freedom of movement of the outer annular wall of the piston head. In addition, the fact that the wall part is in more than one part makes it possible completely to cover the entire open surface of the annular cooling oil space. If the wall part were made in one piece, on the other hand, this would not be possible because the cross-sections of the gudgeon pin bosses of the piston head taper from the free end of their respective bosses towards the crown of the piston head, so that a one-piece wall part which completely covers the annular cooling oil space could not be pushed over the bosses.

Alternative solutions to the problem are the objects of the present invention.

Expedient further developments of the solutions according to the invention are contained in the sub-claims.

Other advantages and features of the invention will be apparent from the disclosure, which includes the above and ongoing specification with the claims and the drawings.

DETAILED DESCRIPTION OF THE PREFERRED EMBODIMENT

Figure 1:
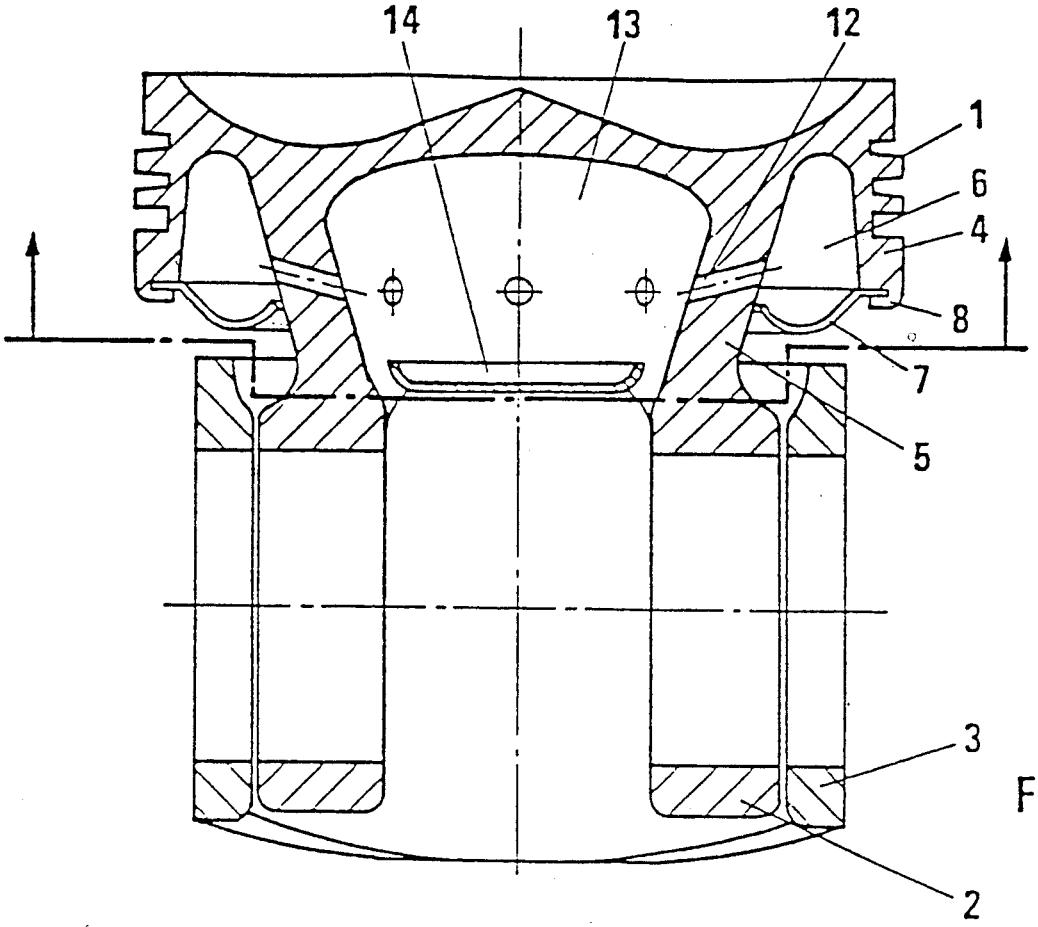
FIG. 1 is a longitudinal section through a piston.
Figure 2:
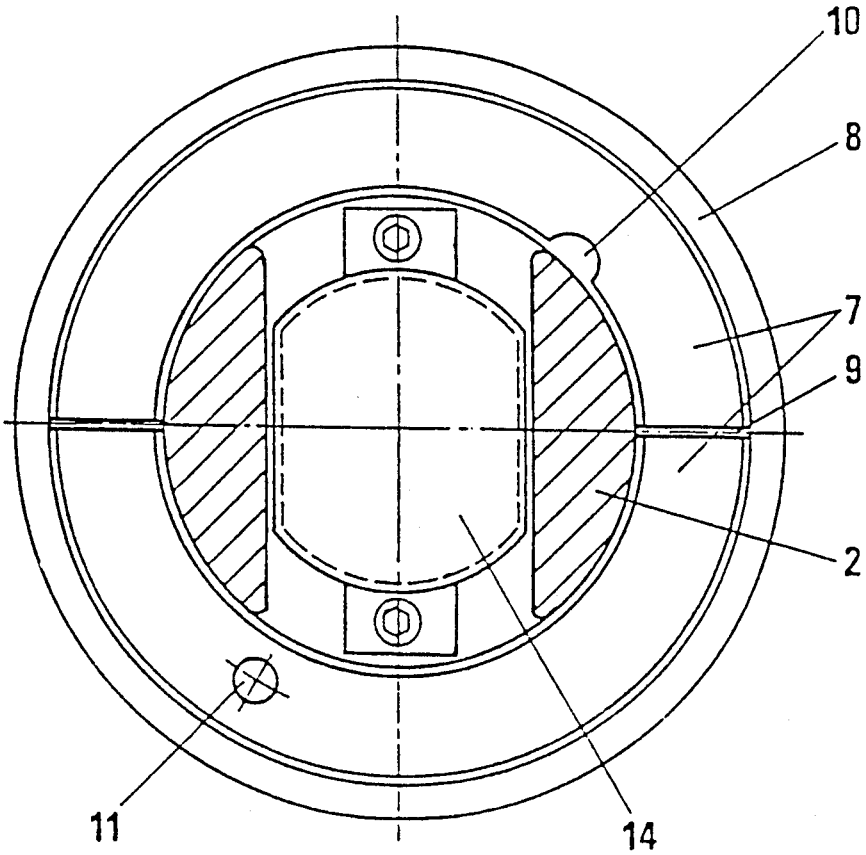
FIG. 2 shows a section taken through the piston as indicated by the arrows II—II.

Altogether, the piston consists of a head part 1 on the boss 2 of which a piston skirt 3 is articulated via a gudgeon pin, not shown.

From the crown of the head part 1, extends an annular wall 4 containing the grooves for the piston rings. Spaced apart radially within the annular wall 4, an annular rib 5 connects the bosses 2 to the piston crown. Between the annular rib 5 and the annular wall 4 there is an annular cavity 6 which is covered by a sheet metal part 7 shaped like an annular trough to form a closed annular space. Cooling oil can be applied to the cavity 6 through the sheet metal part 7.

The sheet metal part 7 bears on the inner edge of the free annular end face of the annular wall 4 where it is held by a collar 8 flanged over in a radially inwards direction and starting from the outer edge of the annular wall.

The sheet metal part 7 is divided radially into two halves. These halves bear on each other at joints 9.

The supply of oil to the annular cavity 6 takes place via a recess 10 provided at the inner edge of the sheet metal part 7.

The oil is carried away through a diametrically opposed aperture 11 which may be disposed in the bottom of the annular trough in the sheet metal part 7. However, the aperture 11 may also take the form of a recess on the inner edge of the sheet metal part 7 and so correspond to the construction of the oil feed aperture.

In order also to be able to conduct cooling oil out of the outer annular cavity 6 into the space disposed radially within the annular rib 5, the annular rib 5 comprises radial bores 12 to achieve a shaker effect in the space 13 disposed radially within the annular rib 5, this space is at its open end which is towards the connecting rod head covered by an additional dish-shaped sheet metal part 14. Oil can flow out of this space through the gap between the sheet metal part 14 and the annular rib 5 or the bosses 2.

Figure 3:
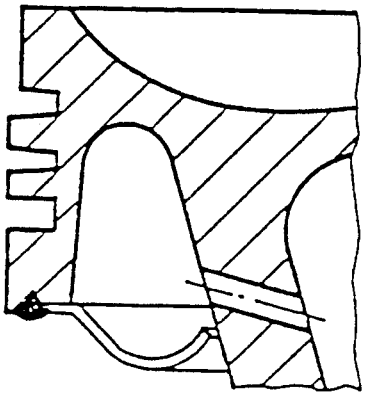
FIG. 3 is a detail from a longitudinal section through a piston having a welded-on covering wall and FIG. 4 is a detail from a longitudinal section through a piston having a screwed-on covering wall.
Figure 4:
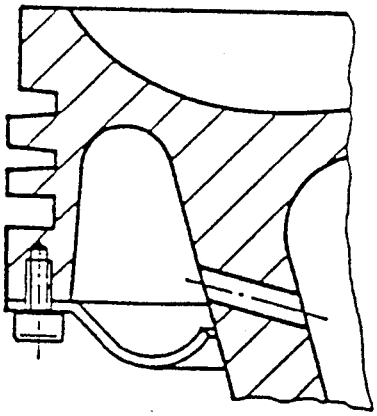

The sheet metal part 7 which covers the outer annular cavity 6 can instead be attached to the outer annular wall 4 by being welded or screwed. A welded joint is shown in FIG. 3 and a screwed joint in FIG. 4.

We claim:

1. A coolable trunk piston for internal combustion engines consisting of a head part with, swaged thereon, bosses to accommodate a gudgeon pin which connects the piston to a connecting rod, an outer annular wall merging at a first end into a crown of the piston head part and at its other end running out in open fashion to accommodate at least one piston ring groove and having radially adjacent an interior of this annular wall and open towards a second end thereof a cavity enclosing the bosses or bracing parts which extend to a bottom of the piston head and the cavity may in particular be a kind of annular rib which, substantially at the height of a second end of the annular wall, can be closed by a wall part adapted to be attached to the annular wall, in order to form a space through which cooling oil can flow, and a piston stem connected to the head part only by means of the gudgeon pin, characterized in that the wall part bears on a collar flanged over an edge of the wall part and projecting radially inwardly from an annular end face of the annular wall and the wall part is divided radially at least once on its periphery, individual parts not being connected directly to each other.

2. A plunger piston according to claim 1 characterized in that at least for a supply of oil to the annular cavity (6) in the head part (1), a radial recess is formed into an inner edge of the wall part.

3. A coolable trunk piston according to claim 1, further characterized in that the wall part is a sheet metal part.

4. A coolable trunk piston according to claim 1, further characterized in that the wall part is formed as an annular trough, a side of the trough being toward the annular cavity in the head part.

5. A coolable trunk piston for internal combustion engines consisting of a head part with, swaged thereon, bosses to accommodate a gudgeon pin which connects the piston to a connecting rod, an outer annular wall merging at a first end into a crown of the piston head part and at its other end running out in open fashion to accommodate at least one piston ring groove and having radially adjacent an interior of this annular wall and open towards a second end thereof a cavity enclosing the bosses or bracing parts which extend to a bottom of the piston head and the cavity may in particular be a kind of annular rib which, substantially at the height of a second end of the annular wall, can be closed by a wall part adapted to be attached to the annular wall, in order to form a space through which cooling oil can flow, and a piston stem connected to the head part only by means of the gudgeon pin, characterized in that the wall part is secured to the annular wall in a region of an open end thereof by individual screws engaging into the annular wall and the wall part has over its periphery at least one radial division, individual parts bearing on each other at joints.

6. A coolable trunk piston according to claim 5, further characterized in that the wall part is a sheet metal part.

7. A coolable trunk piston according to claim 5, further characterized in that the wall part is formed as an annular trough, a side of the trough being toward the annular cavity in the head part.

8. A coolable trunk piston according to claim 5, further characterized in that, at least for a supply of oil to the annular cavity in the head part, a radial recess is formed into an inner edge of the wall part.

9. A coolable trunk piston for internal combustion engines, consisting of a head part with, swaged thereon, bosses to accommodate a gudgeon pin which connects the piston to a connecting rod, an outer annular wall merging at a first end into a crown of the piston head part and at its other end running out in open fashion to accommodate at least one piston ring groove and having radially adjacent an interior of this annular wall and open towards a second end thereof a cavity enclosing the bosses or bracing parts which extend to a bottom of the piston head and the cavity may in particular be a kind of annular rib which, substantially at the height of a second end of the annular wall, can be closed by a wall part adapted to be attached to the annular wall, in order to form a space through which cooling oil can flow, and a piston stem connected to the head part only by means of the gudgeon pin, characterized in that the wall part is welded or soldered to the annular wall in a region of a open end and the wall part has over its periphery at least one radial division, individual parts bearing on each other at joints.

10. A coolable trunk piston according to claim 9, further characterized in that the wall part is a sheet metal part.

11. A coolable trunk piston according to claim 9, further characterized in that the wall part is formed as an annular trough, a side of the trough being toward the annular cavity in the head part.

12. A coolable trunk piston according to claim 9, further characterized in that, at least for a supply of oil to the annular cavity in the head part, a radial recess is formed into an inner edge of the wall part.

13. A coolable trunk piston for internal combustion engines comprising a) a head portion having
   (i) a crown,
   (ii) an outer annular wall contiguous with a marginal region of said crown, said crown closing a proximal end of said annular wall, said annular wall accommodating at least one piston ring groove,
   (iii) a collar formed on a distal end of said annular wall and flanged over to project radially inwardly from an annular end face of the annular wall,
   (iv) an annular rib extending from said crown and within the annular wall defining therewith an annular cavity closed at a first end by said crown, and
   (v) gudgeon pin bosses disposed at a distal end of said annular rib, said bosses serving to accommodate a gudgeon pin for connection of a connecting rod, b) a skirt portion having apertures serving for connection of the skirt portion to the bosses of said head portion by means only of said gudgeon pin, and c) an annular plate-like wall portion secured at a marginal region thereof by said flanged-over collar and disposed substantially in a region of the distal end of the annular rib to close a second end of said cavity remote from the crown to form with said annular wall and said rib a space through which cooling oil can flow, said wall portion being divided radially into individual parts which are not connected directly to each other.

14. A piston according to claim 13, wherein a radial recess is formed in a radially inner edge of the wall portion for supply of oil to the annular cavity in the head portion.

15. A piston according to claim 13, wherein said wall portion is formed from sheet metal.

16. A piston according to claim 13, wherein said wall portion is formed with an annular trough, a concave side of the trough facing toward the annular cavity in the head portion.

17. A coolable trunk piston for internal combustion engines comprising a) a head portion having (i) a crown, (ii) an outer annular wall contiguous with a marginal region of said crown, said crown closing a proximal end of said annular wall, said annular wall accommodating at least one piston ring groove, (iii) an annular rib extending from said crown and within the annular wall defining therewith an annular cavity closed at a first end by said crown, and (iv) gudgeon pin bosses disposed at a distal end of said annular rib, said bosses serving to accommodate a gudgeon pin for connection of a connecting rod, b) a skirt portion having apertures serving for connection of the skirt portion to the bosses of said head portion by means only of said gudgeon pin, and c) an annular plate-like wall portion secured at a marginal region thereof by screwing into a distal end of said annular wall and disposed substantially in a region of the distal end of the annular rib to close a second end of said cavity remote from the crown to form with said annular wall and said rib a space through which cooling oil can flow, said wall portion being divided radially into individual parts which are not connected directly to each other.

18. A piston according to claim 17, wherein a radial recess is formed in a radially inner edge of the wall portion for supply of oil to the annular cavity in the head portion.

19. A piston according to claim 17, wherein said wall portion is formed from sheet metal.

20. A piston according to claim 17, wherein said wall portion is formed with an annular trough, a concave side of the trough facing toward the annular cavity in the head portion.

21. A coolable trunk piston for internal combustion engines comprising a) a head portion having (i) a crown, (ii) an outer annular wall contiguous with a marginal region of said crown, said crown closing a proximal end of said annular wall, said annular wall accommodating at least one piston ring groove, (iii) an annular rib extending from said crown and within the annular wall defining therewith an annular cavity closed at a first end by said crown, and (iv) gudgeon pin bosses disposed at a distal end of said annular rib, said bosses serving to accommodate a gudgeon pin for connection of a connecting rod, b) a skirt portion having apertures serving for connection of the skirt portion to the bosses of said head portion by means only of said gudgeon pin, and c) an annular plate-like wall portion secured at a marginal region thereof by welding or soldering to a distal end of said annular wall and disposed substantially in the region of the distal end of the annular rib to close a second end of said cavity remote from the crown to form with said annular wall and said rib a space through which cooling oil can flow, said wall portion being divided radially into individual parts which are not connected directly to each other.

22. A piston according to claim 21, wherein a radial recess is formed in a radially inner edge of the wall portion for supply of oil to the annular cavity in the head portion.

23. A piston according to claim 21, wherein said wall portion is formed from sheet metal.

24. A piston according to claim 21, wherein said wall portion is formed with an annular trough, a concave side of the trough facing toward the annular cavity in the head portion.

* * * * *